US005726356A

United States Patent [19]

Kukita et al.

[11] Patent Number: 5,726,356

[45] Date of Patent: Mar. 10, 1998

[54] TESTING APPARATUS FOR COMBUSTIBLE CHARGE INTAKE SYSTEM

[75] Inventors: Hiroshi Kukita, Yokohama; Hirotada Muraki, Atsugi, both of Japan

[73] Assignee: Nissan Motor Co., Ltd., Kanagawa, Japan

[21] Appl. No.: 674,235

[22] Filed: Jun. 28, 1996

[30] Foreign Application Priority Data

Jun. 29, 1995 [JP] Japan ..... 7-163836

[51] Int. Cl.[6] ..... F02D 9/02

[52] U.S. Cl. ..... 73/118.2

[58] Field of Search ..... 73/118.1, 118.2, 73/116, 117.3; 123/399

[56] References Cited

U.S. PATENT DOCUMENTS

| | | | |
|---|---|---|---|
| 4,437,342 | 3/1984 | Hosaka et al. . | |
| 5,074,267 | 12/1991 | Ironside et al. | 123/399 |
| 5,079,946 | 1/1992 | Motamedi et al. | 73/118.1 |
| 5,137,004 | 8/1992 | Takahata et al. . | |
| 5,159,831 | 11/1992 | Kitagawa et al. | 73/118.1 |
| 5,193,506 | 3/1993 | Ironside et al. | 123/399 |
| 5,255,653 | 10/1993 | Ironside et al. | 123/399 |
| 5,321,980 | 6/1994 | Hering et al. | 73/118.1 |
| 5,447,134 | 9/1995 | Yokoyama | 73/118.1 |
| 5,521,825 | 5/1996 | Unuvar et al. | 73/118.2 |

FOREIGN PATENT DOCUMENTS

| | | |
|---|---|---|
| 121 937 A1 | 10/1984 | European Pat. Off. . |
| 4312336 A1 | 3/1997 | Germany . |
| 5-296097 | 11/1993 | Japan . |

*Primary Examiner*—Elizabeth L. Dougherty
*Assistant Examiner*—Eric S. McCall
*Attorney, Agent, or Firm*—Lowe, Price, LeBlanc & Becker

[57] ABSTRACT

A testing apparatus for a combustible charge intake system of an internal combustion engine, including a throttle position sensor and a throttle switch respectively coupled with a throttle valve, an accelerator switch coupled with an accelerator pedal, and a control unit operatively coupled with the switches. The control unit is operative to determine that the throttle valve has failed to operate normally when the throttle switch fails to shift to its predetermined state after the accelerator switch has shifted to its predetermined state. The control unit is operative to determine that the accelerator switch fails to operate normally in response to the control unit determining that the accelerator switch has failed to take the predetermined state thereof after the throttle switch has been in the predetermined state thereof.

14 Claims, 7 Drawing Sheets

TESTING APPARATUS FOR COMBUSTIBLE CHARGE INTAKE SYSTEM

BACKGROUND OF THE INVENTION

The present invention relates to a testing apparatus for a combustible charge intake system of an internal combustion engine.

There has been proposed or known a combustible charge intake system of an internal combustion engine including a power control element, e.g., a throttle valve in the case of a gasoline engine or an adjusting lever of a fuel injection pump in the case of a diesel engine, positionable by an actuator in response to a control signal to establish various states of combustible charge to be combusted in the engine. A control unit is operatively coupled with a position sensor operatively coupled with the power control element and an accelerator position sensor operatively coupled with an accelerator or gas pedal manipulable by an operator. The control unit develops the control signal as a predetermined function of a position or a degree of depression of the accelerator pedal.

In order to enhance reliability of or safeguard the system of this kind, Japanese Patent Application First Publication No. 5-296097 discloses a testing apparatus for conducting a test routine to determine whether or not the throttle valve operates normally and produces an alarm if the throttle valve fails to operate normally. The test involves a logic that the throttle valve fails to operate normally when a throttle switch fails to shift to its closed position after an accelerator switch has shifted to its closed position. The throttle switch is designed to be closed when the throttle valve is closed, while the accelerator switch is designed to be closed when the accelerator pedal is released.

An object of the present invention is to enhance reliability of a testing apparatus of the above kind.

SUMMARY OF THE INVENTION

According to one aspect of the present invention, there is provided, in a testing apparatus for a combustible charge intake system of an internal combustion engine, including a power control element positionable in response to a control signal to establish various states of combustible charge to be combusted in the internal combustion engine, a position sensor operatively coupled with the power control element to provide an actual position signal indicative of a position which the power control element takes, a control unit for developing the control signal as a predetermined function of a position of an accelerator pedal, a first switch shiftable to a predetermined state in response to the accelerator pedal moving below a predetermined position, and a second switch shiftable to a predetermined state when a position which the power control element takes is less than a predetermined position, the control unit being operatively coupled with the first and second switches, the improvement wherein the control unit is operative to determine whether or not the actual position signal is equal to or less than a predetermined value;

the control unit is operative to determine whether or not the second switch is in the predetermined state thereof after the control unit determining that the actual position signal has been equal to or less than the predetermined value;

the control unit is operative to determine whether or not the first switch fails to take the predetermined state thereof after the control unit determining that the second switch has been in the predetermined state thereof; and the control unit is operative to determine that the first switch fails to operate normally in response to the control unit determining that the first switch has failed to take the predetermined state thereof after the second switch has been in the predetermined state thereof.

According to another aspect of the present invention, there is provided, in a testing apparatus for a combustible charge intake system of an internal combustion engine, including a power control element positionable in response to a control signal to establish various states of combustible charge to be combusted in the internal combustion engine, a position sensor operatively coupled with the power control element to provide an actual position signal indicative of a position which the power control element takes, a control unit for developing the control signal as a predetermined function of a position of an accelerator pedal, a first switch shiftable to a predetermined state in response to the accelerator pedal moving below a predetermined position, and a second switch shiftable to a predetermined state when a position which the power control element takes is less than a predetermined position, the control unit being operatively coupled with the first and second switches and operative to determine that the power control element has failed to operate normally when the second switch fails to shift to the predetermined state thereof after the first switch has shifted to the predetermined state thereof, the improvement wherein the control unit is operative to determine whether or not the actual position signal is equal to or less than a predetermined value;

the control unit is operative to determine whether or not the second switch is in the predetermined state thereof after the control unit determining that the actual position signal has been equal to or less than the predetermined value;

the control unit is operative to determine whether or not the first switch fails to take the predetermined state thereof after the control unit determining that the second switch has been in the predetermined state thereof; and the control unit is operative to determine that the first switch fails to operate normally in response to the control unit determining that the first switch has failed to take the predetermined state thereof after the second switch has been in the predetermined state thereof.

According to still another aspect of the present invention, there is provided a testing apparatus for a combustible charge intake system of an internal combustion engine including a power control element positionable in response to a control signal to establish various states of combustible charge to be combusted in the internal combustion engine, a position sensor operatively coupled with the power control element to provide an actual position signal indicative of a position which the power control element takes, a control unit for developing the control signal as a predetermined function of a position of an accelerator pedal, a first switch shiftable to a predetermined state in response to the accelerator pedal moving below a predetermined position, and a second switch shiftable to a predetermined state when a position which the power control element takes is less than a predetermined position;

wherein the control unit is operatively coupled with the first and second switches;

the control unit is operative to determine whether or not the actual position signal is equal to or less than a predetermined value;

the control unit is operative to determine whether or not the second switch is in the predetermined state thereof after the control unit determining that the actual position signal has been equal to or less than the predetermined value;

the control unit is operative to determine whether or not the first switch fails to take the predetermined state thereof after the control unit determining that the second switch has been in the predetermined state thereof;

the control unit is operative to determine that the first switch fails to operate normally in response to the control unit determining that the first switch has failed to take the predetermined state thereof after the second switch has been in the predetermined state thereof; and the control unit is operative to conduct a test routine, when the control unit determines that the first switch operates normally, to determine whether or not the power control element operates normally wherein the control unit determines that the power control element has failed to operate normally when the second switch fails to shift to the predetermined state thereof after the first switch has shifted to the predetermined state thereof.

According to still another aspect of the present invention, there is provided a testing method for a combustible charge intake system of an internal combustion engine, including a power control element positionable in response to a control signal to establish various states of combustible charge to be combusted in the internal combustion engine, a position sensor operatively coupled with the power control element to provide an actual position signal indicative of a position which the power control element takes, a control unit for developing the control signal as a predetermined function of a position of an accelerator pedal, a first switch shiftable to a predetermined state in response to the accelerator pedal moving below a predetermined position, and a second switch shiftable to a predetermined state when a position which the power control element takes is less than a predetermined position, the control unit being operatively coupled with the first and second switches and operative to determine that the power control element has failed to operate normally when the second switch fails to shift to the predetermined state thereof after the first switch has shifted to the predetermined state thereof, the testing method comprising the steps of:

determining whether or not the actual position signal is equal to or less than a predetermined value;

determining whether or not the second switch is in the predetermined state thereof after the control unit determining that the actual position signal has been equal to or less than the predetermined value;

determining whether or not the first switch fails to take the predetermined state thereof after the control unit determining that the second switch has been in the predetermined state thereof; and determining that the first switch fails to operate normally in response to the control unit determining that the first switch has failed to take the predetermined state thereof after the second switch has been in the predetermined state thereof.

DETAILED DESCRIPTION OF THE INVENTION

Figure 1:
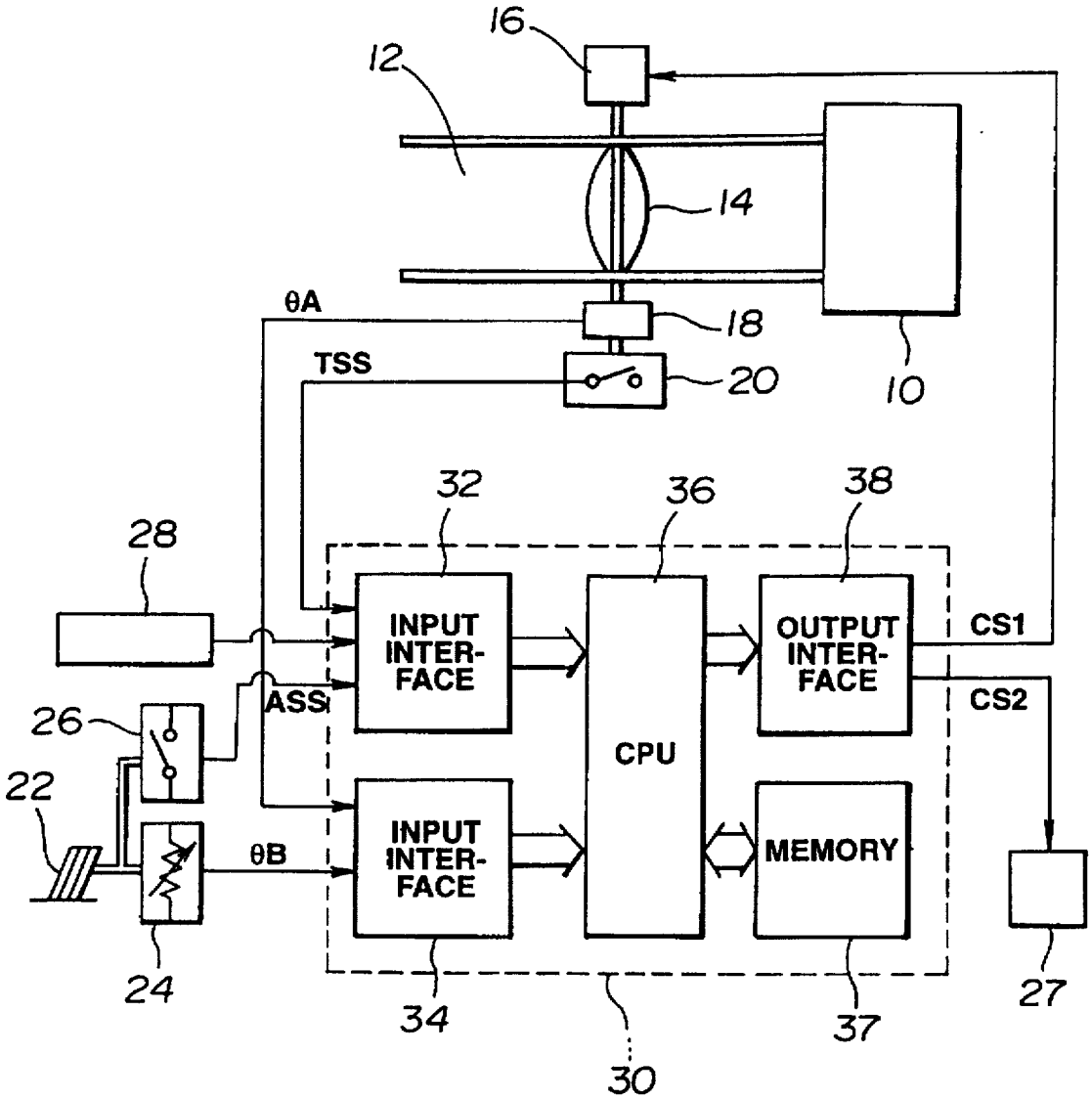
FIG. 1 is a block diagram of a testing apparatus for a combustible charge intake system of a gasoline engine.

Referring to FIG. 1, there is illustrated a first embodiment of a testing apparatus for a combustible charge intake system of an internal combustion engine. In this embodiment, the internal combustion engine is a gasoline engine 10.

As illustrated in FIG. 1, the gasoline engine 10 includes an air induction passage 12. A throttle valve 14 is disposed within the air induction passage 12. The throttle valve 14 acts as a power control element positionable in response to a control signal to establish various states of combustible charge to be combusted in the gasoline engine 10. An actuator 16, e.g. stepping motor or direct current motor, is provided for actuating the throttle valve 14 to control an amount of intake air flowing to the air induction passage 12. A throttle position sensor 18 is operatively coupled with the throttle valve 14 to provide an actual position signal θA indicative of a position which the throttle valve 14 takes. The position of the throttle valve 14 is indicated by a value of opening degree of the throttle valve 14. A throttle switch 20 is so disposed and arranged as to be shiftable to a predetermined state when the position which the throttle valve 14 takes is less than a predetermined position. In this embodiment, the predetermined state of the throttle switch 20 is a closed state, namely an ON state. The throttle switch 20 generates a signal TSS while it is in the ON state. An accelerator or gas pedal 22 is so disposed as to be moveable between a released position and a fully depressed position in response to operator power demand. An accelerator position sensor 24 is operatively coupled with the accelerator pedal 22 to detect a position which the accelerator pedal 22 takes and generate a position signal θB indicative of the position thereof. An accelerator switch 26 is so disposed and arranged as to be shiftable to a predetermined state in response to the accelerator pedal 22 moving below a predetermined position. In this embodiment, the predetermined state of the accelerator switch 28 is a closed state, namely an ON state in which the accelerator pedal 22 reaches the released position. The accelerator switch 28 generates a signal ASS while it is in the ON state. An alarm light 27 is provided for indicating that the accelerator switch 26 fails to operate normally. An engine revolution sensor 28 is provided for detecting the number of revolution of the engine 10.

A control unit 30 is operatively coupled with the throttle position sensor 18, the throttle switch 20, the accelerator position sensor 24, the accelerator switch 28, and the engine revolution sensor 28. The control unit 30 is of the microcomputer based control module including as usual input interfaces 32 and 34, a CPU (central processing unit) 38, a memory 37, i.e. ROM and RAM, and an output interface 38. The signals TSS and ASS generated from the throttle switch 20 and the accelerator switch 26, respectively, are fed to the input interface 32. The signals θA and θB generated from the throttle position sensor 18 and the accelerator position sensor 24, respectively, are fed to the input interface 34. The control unit 30 is operative to develop the control signal CS1 as a predetermined function of the accelerator pedal 22. The control signal CS1 is transmitted to the actuator 16 via the output interface 38 for varying the position of the throttle valve 14. The control unit 30 is operative to develop a control signal CS2 for illuminating the alarm light 27.

The control unit 30 monitors an operation of the throttle valve 14 during an engine operation. The control unit 30 is operative to determine that the throttle valve 14 has failed to operate normally when the throttle switch 20 fails to shift to the ON state thereof after the accelerator switch 26 has shifted to the ON state thereof. Specifically, the control unit 30 is operative to conduct a test routine, when the control unit 30 determines that the accelerator switch 28 operates normally, to determine whether or not the throttle valve 14 operates normally. This test routine will be explained later by referring to FIG. 6.

The control unit 30 performs a diagnostic test for detecting whether or not the accelerator switch 26 operates normally during the engine operation.

Specifically, the control unit 30 is operative to determine whether or not the actual position signal θA is equal to or less than a predetermined value θ1, and then whether or not the actual position signal θA continues to be equal to or less than the predetermined value θ1 for a first predetermined period of time P1.

Figure 3:
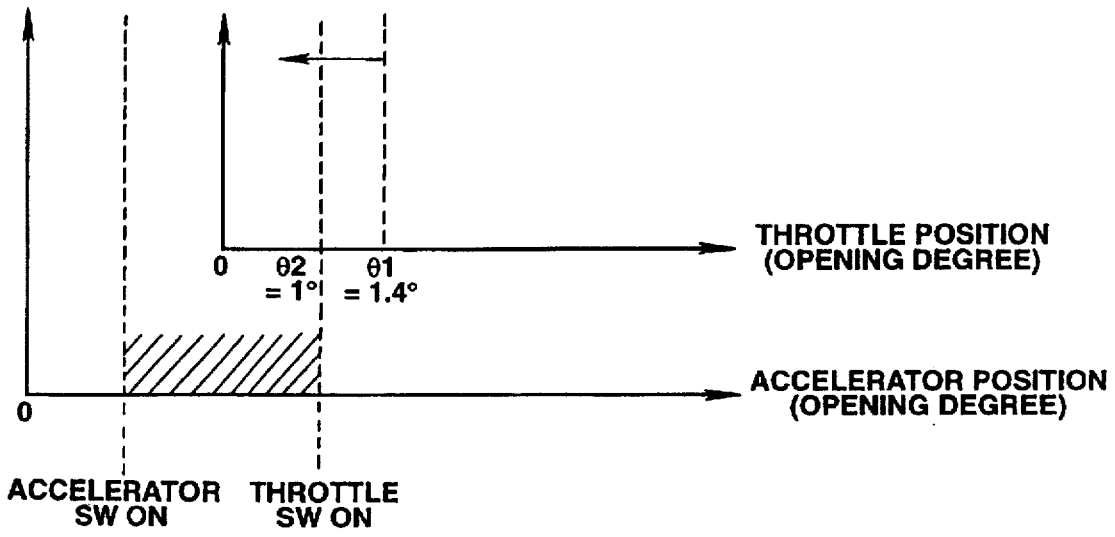
FIG. 3 is a graphic diagram illustrating a relation between a throttle valve position, a throttle switch, and the accelerator switch.

As illustrated in FIG. 3, if the predetermined value θ1 is 1.4 opening degrees, the control unit 30 determines whether or not the actual position signal θA is equal to or less than 1.4 opening degrees and whether or not the actual position signal θA continues to be equal to or less than 1.4 opening degrees for the first predetermined period of time P1, e.g. three seconds.

The control unit 30 is operative to determine whether or not the throttle switch 20 is in the ON state thereof after the control unit 30 determining that the actual position signal θA has continued to be equal to or less than the predetermined value θ1 for the first predetermined period of time P1. In the ON state of the throttle switch 20, the actual position signal θA is a predetermined second value θ2 less than the predetermined value θ1. In FIG. 3, the throttle switch shifts to the ON state in which the actual position signal θA is 1.0 opening degrees and the predetermined second value θ2 is equal to or less than 1.0 opening degrees. The control unit 30 is operative to determine whether or not the throttle switch 20 continues to take the ON state thereof for a second predetermined period of time P2, e.g. three seconds. The second predetermined period of time P2 may be a different value from the first predetermined period of time P1.

In addition, the control unit 30 is operative to determine whether or not the accelerator switch 26 fails to take the ON state thereof after the control unit 30 determining that the throttle switch 20 has continued to take the ON state thereof for the second predetermined period of time P2. FIG. 3 shows a timing when the accelerator switch 26 shifts to the ON state thereof, which is after the timing when the throttle switch 20 shifts to the ON state thereof. The control unit 30 determines whether or not the accelerator switch 26 continues to fail to take the ON state thereof for a third predetermined period of time P3, e.g. ten seconds. The third predetermined period of time P3 is greater than the first and second predetermined periods of time P1 and P2.

The control unit 30 is operative to determine that the accelerator switch 26 fails to operate normally in response to the control unit 30 determining that the accelerator switch 26 has continued to fail to take the ON state thereof for the third predetermined period of time P3 after the throttle switch 20 has continued to take the ON state thereof for the second predetermined period of time P2.

Figure 2A:
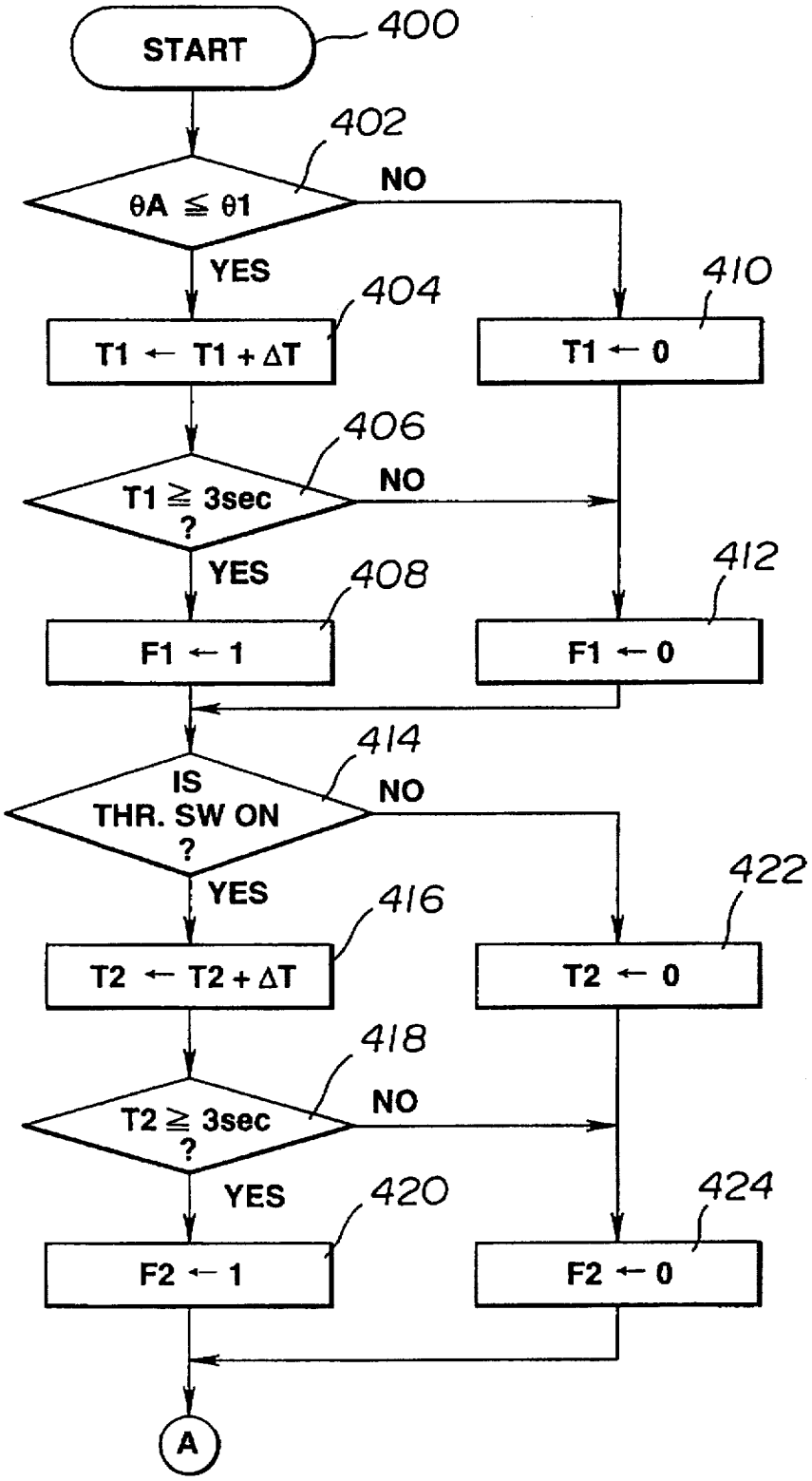
FIGS. 2A and 2B are a flow diagram of a test routine to determine whether an accelerator switch fails to operate normally during an engine operation.
Figure 2B:
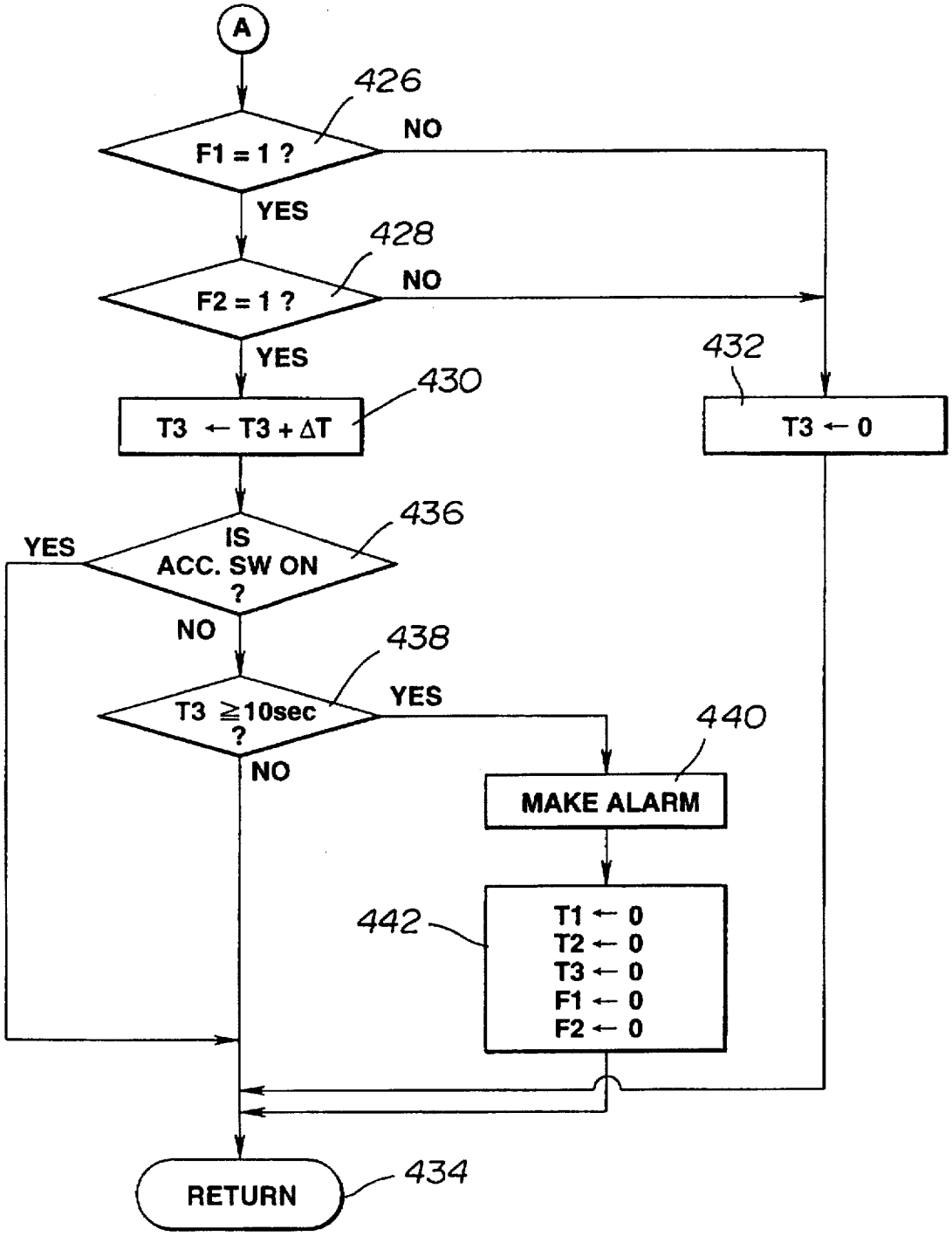

FIGS. 2A and 2B are a flow diagram implementing the diagnostic test. This test is repeatedly executed at regular intervals during the engine operation. The test routine begins at a start point 400. Logic flow then goes to a decision block 402 where an interrogation is made whether or not the actual position signal θA of the throttle position sensor 18 is equal to or less than the predetermined value θ1. If the interrogation is in affirmative, the logic flow goes to a block 404 where time T1 for which the actual position signal θA continues to be equal to or less than the predetermined value θ1 is measured. The time T1 is updated by adding an increment ΔT (delta T) to the time T1 measured in the preceding execution of the test routine. The logic flow then goes to a decision block 408 where an interrogation is made whether or not the time T1 becomes equal to or more than the first predetermined period of time P1, e.g. three seconds. If the interrogation is in affirmative, the logic flow goes to a block 408 where a flag F1 is set, indicating that throttle position condition is met. If, at the block 402, the interrogation results in negative, the logic flow goes to a block 410 where the time T1 is reset at zero and then goes to a block 412 where the flag F1 is cleared indicating that the throttle position condition is not met. Also if, at the block 406, the interrogation results in negative, the logic flow goes to the block 412 where the flag F1 is cleared. The logic flow then goes to a decision block 414 where an interrogation is made whether or not the throttle switch 20 is in the ON state thereof. If the interrogation is in affirmative, the logic flow goes to a block 418 where time T2 for which the throttle switch 20 continues to take the ON state thereof is measured. The time T2 is updated by adding an increment ΔT (delta T) to the time T2 measured in the preceding execution of the test routine. The logic flow then goes to a decision block 418 where an interrogation is made whether or not the time T2 becomes equal to or more than the second predetermined period time P2, e.g. three seconds. If the interrogation is in affirmative, the logic flow goes to a block 420 where a flag F2 is set, indicating that throttle switch condition is met. If, at the block 414, the interrogation results in negative, the logic flow goes to a block 422 where the time T2 is reset at zero and further goes to a block 424 where the flag F2 is cleared indicating that the throttle switch condition is not met. If, at the block 418, the interrogation results in negative, the logic flow goes to the block 424 where the flag F2 is cleared.

The logic flow then goes to a decision block 428 where an interrogation is made whether or not the flag F1 is kept set. If the interrogation results in affirmative, the logic flow goes to a decision block 428 where an interrogation is made whether or not the flag F2 is kept set. If the interrogation results in affirmative, the logic flow goes to a block 430 where time T3 for which the flag F1 and the flag F2 are kept set, respectively, is measured. The time T3 is updated by adding an increment ΔT (delta T) to the time T3 measured in the preceding execution of the test routine. If, at the blocks 426 and 428, the interrogations result in negative, respectively, the logic flow goes to a block 432 where the time T3 is reset at zero and further goes to a return point 434 to start the routine again from the start point 400. Subsequent to the block 430, the logic flow goes to a decision block 438 where an interrogation is made whether or not the accelerator switch 26 is in the ON state thereof. If the interrogation is in affirmative, the logic flow goes to the return point 434. If, at the block 436, the interrogation results in negative, the logic flow goes to a decision block 438 where an interrogation is made whether or not the time T3 for which the accelerator switch 26 continues to take the ON state thereof is equal to or more than the third predetermined period of time P3, e.g. ten seconds. If the interrogation results in affirmative, the logic flow goes to a block 440 where an alarm is made to indicate that the accelerator switch 26 fails to operate normally. In this embodiment, the alarm light 27 is illuminated informing a driver of a vehicle of occurrence of the failure of the accelerator switch 26. The logic flow then goes to a block 442 where the time T1, the time T2, the time T3 are reset at zero and the flag F1 and the flag F2 are cleared, and further goes to the return point 434 and the routine begins again from the start point 400. If, at the block 438, the interrogation is in negative, the logic flow goes to the return point 434 to repeat this routine from the start point 400.

Figure 4:
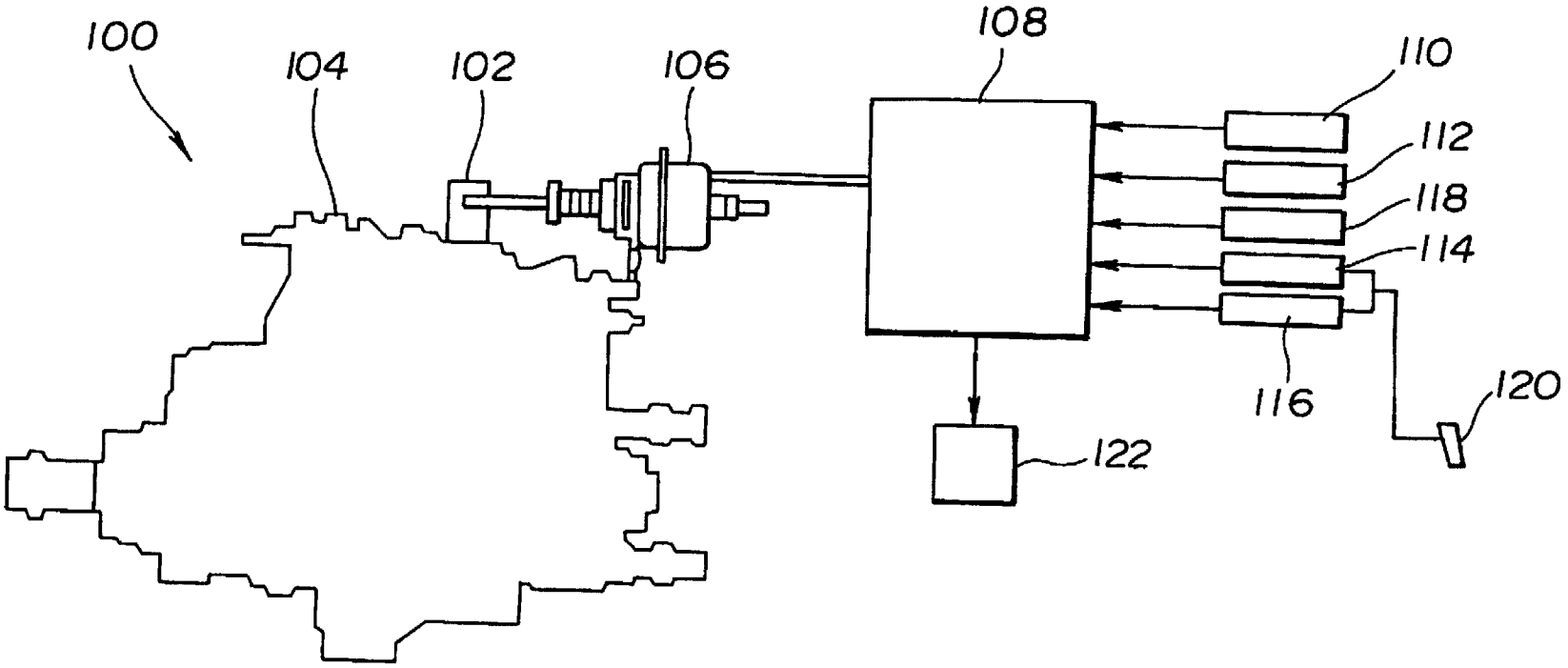
FIG. 4 is a block diagram of a testing apparatus for a combustible charge intake system of a diesel engine.
Figure 5:
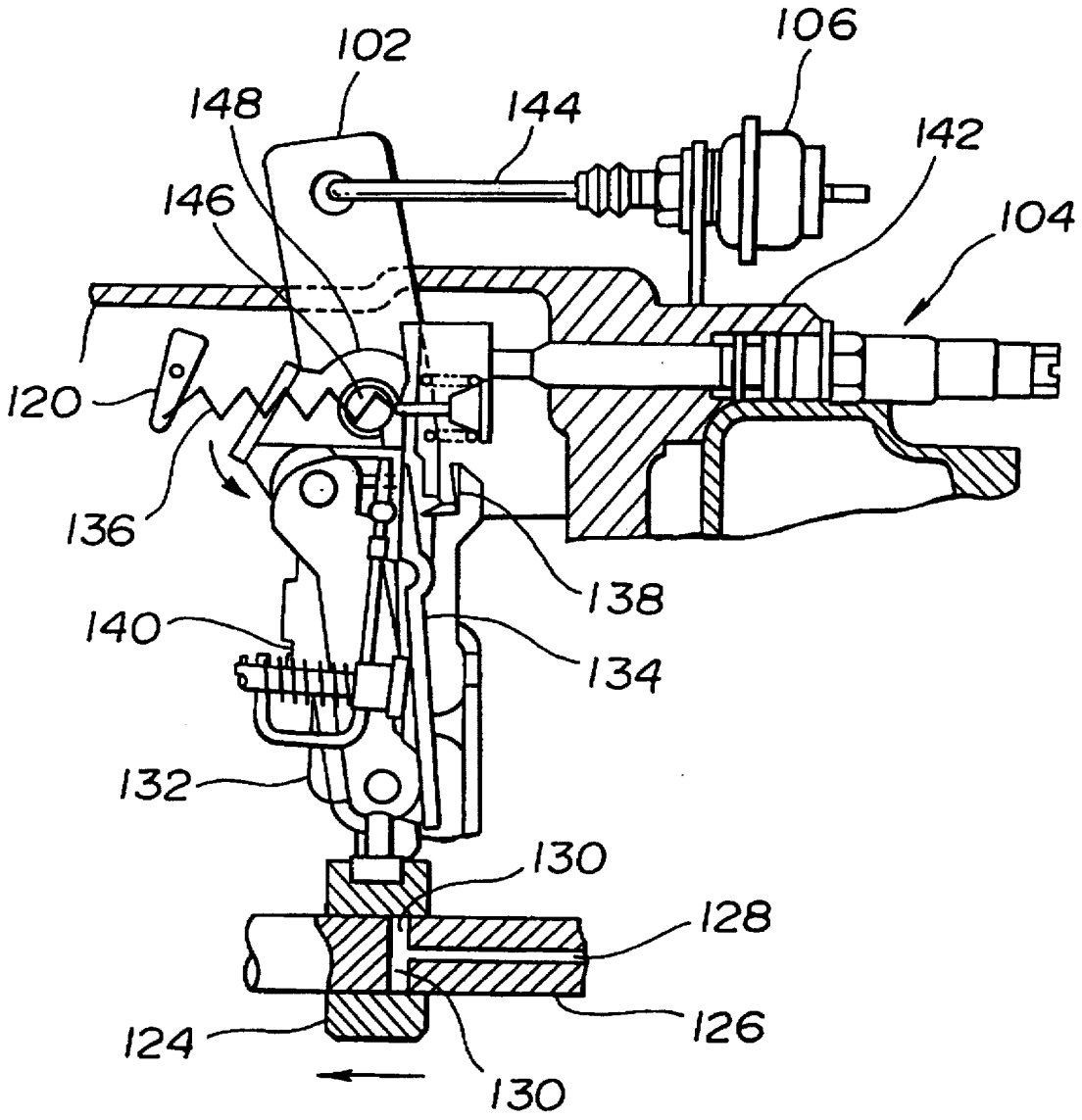
FIG. 5 is a fragmentary view, partly in section, of a fuel injection pump of the diesel engine shown FIG. 5.

Referring to FIGS. 4 and 5, a second embodiment of the testing apparatus according to the invention, will now be explained. In this embodiment, the internal combustion engine is a diesel engine 100.

As illustrated in FIG. 4, the testing apparatus includes an adjusting lever 102 acting as the power control element positionable in response to a control signal to establish various states of combustible charge to be combusted in the diesel engine 100. The adjusting lever 102 has one end disposed within an fuel injection pump 104 as described later. An actuator 106, e.g. stepping motor, is provided for actuating the adjusting lever 102 to vary a position which the adjusting lever 102 takes. The actuator 108 is operatively coupled with a control unit 108. The control unit 108 is operatively coupled with an adjusting lever position sensor 110, an adjusting lever switch 112, an accelerator position sensor 114, an accelerator switch 116, and an engine revolution speed sensor 118. The adjusting lever position sensor 110 is operatively coupled with the adjusting lever 102 to provide an actual position signal θA indicative of the position of the adjusting lever 102. The adjusting lever switch 112 is shiftable to a predetermined state, that is, a closed state, when the position of the adjusting lever 102 is equal to or less than a predetermined position. In the second embodiment, the closed state of the adjusting lever switch 112 is an ON state. The adjusting lever switch 112 continues to generate a signal while it is in the ON state. Reference numeral 120 denotes an accelerator or gas pedal operatively connected with the accelerator position sensor 114 and the accelerator switch 116. Reference numeral 122 denotes an alarm light. The accelerator position sensor 114, the accelerator switch 116, the accelerator pedal 120, and the alarm light 122 are similar to the accelerator position sensor 24, the accelerator switch 26, the accelerator pedal 22, and the alarm light 27, as described in the first embodiment, and therefore detailed explanations therefor are omitted. The adjusting lever 102 is operatively connected with a sleeve 124 mounted to the fuel injection pump 104 as shown in FIG. 7. As illustrated in FIG. 7, the sleeve 124 is fit on a plunger 126 disposed within the fuel injection pump 104. The plunger 126 has a fuel passage 128 for distributing fuel to engine cylinders (not shown). The plunger 126 has spill ports 130 communicating with the fuel passage 128 and open to an outer peripheral surface of the plunger 126. The sleeve 124 is displaceable in an axial direction of the plunger 126 to vary fuel discharge from the spill ports 130. Depending on the axial displacement of the sleeve 124, the plunger 126 has different strokes for providing suitable fuel injection for engine operating conditions. The sleeve 124 is operatively connected with a control lever 132 actuated by a centrifugal force adjusting member (not shown) rotatable in response to engine operating conditions, and a tension lever 134 connected with the accelerator pedal 120 via springs 136, 138, and 140. The actuator 106 is mounted to a casing 142 of the fuel injection pump 104. The actuator 106 includes a rod 144 projecting from and retracting into a housing of the actuator 106 in response to angular movement of a rotor (not shown) disposed within the actuator 106. The rod 144 is engaged with the other end of the adjusting lever 102 which projects outward from the casing 142 of the fuel injection pump 104. The adjusting lever 102 is rotatably supported on a shaft 146 and operatively connected at the one end with a rotating lever 148 via the shaft 146. The rotating lever 148 includes a boss portion receiving the shaft 146 and having on its outer peripheral surface a cam surface which is contacted with the tension lever 134. The cam surface is formed by varying steppedly radial dimension of the boss portion. When the actuator 106 is driven, the rotating lever 148 is rotated by the projecting and retracting motions of the rod 144 and then the tension lever 134 is moved. This causes the axial displacement of the sleeve 124 relative to the plunger 126.

In the second embodiment, the control unit 108 is similar to the control unit 30 of the first embodiment and performs a test routine as explained in the first embodiment by using the flow diagram shown in FIGS. 2A and 2B. Therefore, detailed descriptions for the control unit 108 and the diagnostic test executed by the control unit 108 are omitted.

The control unit 30 or 108 is operative to continuously repeat the above-mentioned test routine for avoiding making erroneous determination caused due to detection of operational inconsistency between the throttle switch 20 or adjusting lever switch 112 and the accelerator switch 26 or 116. FIG. 3 illustrates by shadow the operational inconsistency between the throttle switch 20 or adjusting lever switch 112 and the accelerator switch 26 or 116, in which the throttle switch 20 or adjusting lever switch 112 is in the ON state thereof but the accelerator switch 26 or 116 is in the OFF state thereof.

Further, the control unit 30 or 108 is operative to cancel the determination that the accelerator switch 26 or 116 fails to operate normally and make no alarm, unless the determination of failure of the normal operation of the accelerator switch 26 or 116 has been made serially in the current execution of the test routine and the preceding execution thereof during the repeated execution thereof.

Thus, the testing apparatus prevents erroneous determination of state of the accelerator switch which is caused by detecting operational inconsistency between the throttle switch or adjusting lever switch and the accelerator switch. Especially, this apparatus serves for improving the combustible charge intake operation within an idle speed range of the internal combustion engine.

Figure 6:
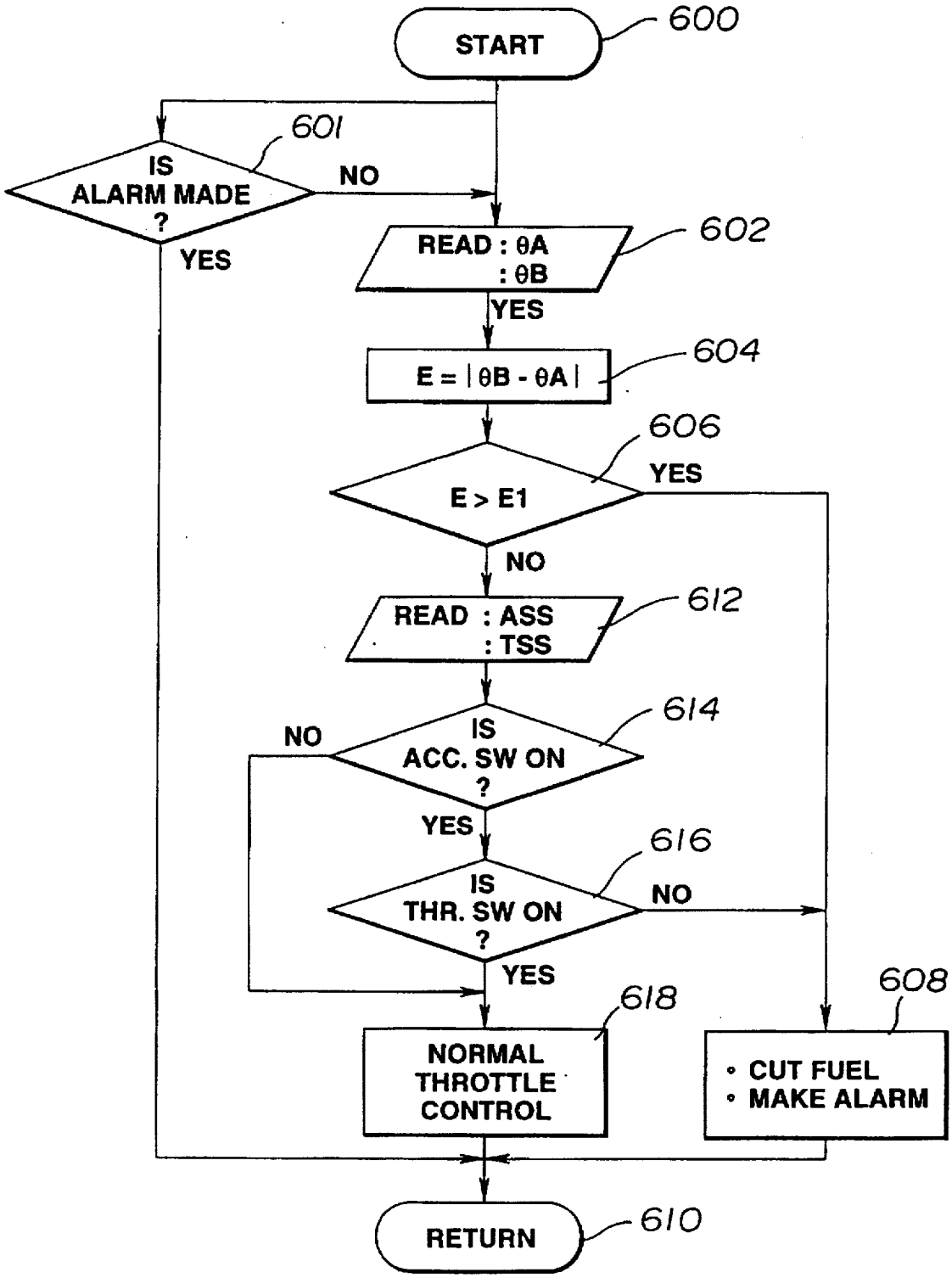
FIG. 6 is a flow diagram of a test routine to determine whether a throttle valve fails to operate normally during an engine operation.

FIG. 6 is a flow diagram of the test routine to determine whether or not the throttle valve 14 fails to operate normally during an operation of a gasoline engine. Execution of this test routine is repeated at regular intervals during the engine operation. The test routine begins at a start point 600. Logic flow goes to a block 601 where there is an interrogation whether or not the alarm is made, namely, whether or not the accelerator switch 26 fails to operate normally. If this is the case, the logic flow goes to a return point 610 to start again the test routine at the start point 600. If not, the logic flow goes to a block 602 where the actual position signal θA generated from the throttle position sensor 18 and the position signal θB generated from the accelerator position sensor 24 are read. Then, the logic flow goes to a block 604 where a deviation E between θB and θA is obtained as an absolute value calculated by subtracting θA from θB. The logic flow goes to a decision block 606 where an interrogation is made whether the deviation E is greater than a predetermined value E1. The predetermined value E1 is calculated based on a difference between θB and a target position signal indicative of a target position which the throttle position sensor 18 is to take. The target position signal is expressed by a function of θB. If, at the block 606, the interrogation is in affirmative, the logic flow goes to a block 608 where the alarm light 27 is illuminated and an instruction to cut fuel feed to all or a part of the engine cylinders is issued. After the block 608, the logic flow goes to the return point 610.

If, at the block 606, the interrogation results in negative, the logic flow then goes to a block 612 where the signal ASS generated from the accelerator switch 26 and the signal TSS generated from the throttle switch 20 are read. The logic flow goes to a decision block 614 where an interrogation is made whether the accelerator switch 26 is in the ON state thereof. If the interrogation is in affirmative, the logic flow goes to a decision block 616 where an interrogation is made whether the throttle switch 20 is in the ON state thereof. If, at the block 616, the interrogation is affirmative, the logic flow then goes to a block 618 where an instruction for a normal throttle control is issued and then to the return point 610.

If, at the block 614, the interrogation results in negative, the logic flow goes to the block 618 and then to the return point 610. At the block 616, if the interrogation results in negative, the logic flow goes to the block 608 and then to the return point 610.

It will be appreciated from the above description that the testing apparatus of the invention serves for improving an operating performance of the combustible charge intake system of the internal combustion engine.

What is claimed is:

1. In a testing apparatus for a combustible charge intake system of an internal combustion engine, including a power control element positionable in response to a control signal to establish various states of combustible charge to be combusted in the internal combustion engine, a position sensor operatively coupled with the power control element to provide an actual position signal indicative of a position which the power control element takes, a control unit for developing the control signal as a predetermined function of a position of an accelerator pedal, a first switch shiftable to a predetermined state in response to the accelerator pedal moving below a predetermined position, and a second switch shiftable to a predetermined state when a position which the power control element takes is less than a predetermined position, the control unit being operatively coupled with the first and second switches, the improvement wherein the control unit is operative to determine whether or not the actual position signal is equal to or less than a predetermined value;

the control unit is operative to determine whether or not the second switch is in the predetermined state thereof after the control unit determining that the actual position signal has been equal to or less than said predetermined value;

the control unit is operative to determine whether or not the first switch fails to take the predetermined state thereof after the control unit determining that the second switch has been in the predetermined state thereof;

the control unit is operative to determine that the first switch fails to operate normally in response to the control unit determining that the first switch has failed to take the predetermined state thereof after the second switch has been in the predetermined state thereof;

the control unit is operative to determine whether or not the actual position signal continues to be equal to or less than said predetermined value for a first predetermined period of time; and the control unit is operative to determine whether or not the second switch continues to take the predetermined state thereof for a second predetermined period of time after the control unit determining that the actual position signal has continued to be equal to or less than said predetermined value for said first predetermined period of time.

2. The improvement as claimed in claim 1, wherein the control unit is operative to determine whether or not the first switch continues to fail to take the predetermined state thereof for a third predetermined period of time after the control unit determining that the second switch has continued to take the predetermined state thereof for said second predetermined period of time.

3. The improvement as claimed in claim 2, wherein the control unit is operative to determine that the first switch fails to operate normally in response to the control unit determining that the first switch has continued to fail to take the predetermined state thereof for said third predetermined period of time after the second switch has continued to take the predetermined state thereof for said second predetermined period of time.

4. In a testing apparatus for a combustible charge intake system of an internal combustion engine, including a power control element positionable in response to a control signal to establish various states of combustible charge to be combusted in the internal combustion engine, a position sensor operatively coupled with the power control element to provide an actual position signal indicative of a position which the power control element takes, a control unit for developing the control signal as a predetermined function of a position of an accelerator pedal, a first switch shiftable to a predetermined state in response to the accelerator pedal moving below a predetermined position, and a second switch shiftable to a predetermined state when a position which the power control element takes is less than a predetermined position, the control unit being operatively coupled with the first and second switches and operative to determine that the power control element has failed to operate normally when the second switch fails to shift to the predetermined state thereof after the first switch has shifted to the predetermined state thereof, the improvement wherein the control unit is operative to determine whether or not the actual position signal is equal to or less than a predetermined value;

the control unit is operative to determine whether or not the second switch is in the predetermined state thereof after the control unit determining that the actual position signal has been equal to or less than said predetermined value;

the control unit is operative to determine whether or not the first switch fails to take the predetermined state thereof after the control unit determining that the second switch has been in the predetermined state thereof;

the control unit is operative to determine that the first switch fails to operate normally in response to the control unit determining that the first switch has failed to take the predetermined state thereof after the second switch has been in the predetermined state thereof;

the control unit is operative to determine whether or not the actual position signal continues to be equal to or less than said predetermined value for a first predetermined period of time; and the control unit is operative to determine whether or not the second switch continues to take the predetermined state thereof for a second predetermined period of time after the control unit determining that the actual position signal has continued to be equal to or less than said predetermined value for said first predetermined period of time.

5. The improvement as claimed in claim 4, wherein the control unit is operative to determine whether or not the first switch continues to fail to take the predetermined state thereof for a third predetermined period of time after the control unit determining that the second switch has continued to take the predetermined state thereof for said second predetermined period of time.

6. The improvement as claimed in claim 5, wherein the control unit is operative to determine that the first switch fails to operate normally in response to the control unit determining that the first switch has continued to fail to take the predetermined state thereof for said third predetermined period of time after the second switch has continued to take the predetermined state thereof for said second predetermined period of time.

7. A testing apparatus for a combustible charge intake system of an internal combustion engine including a power control element positionable in response to a control signal to establish various states of combustible charge to be combusted in the internal combustion engine, a position sensor operatively coupled with the power control element to provide an actual position signal indicative of a position which the power control element takes, a control unit for developing the control signal as a predetermined function of a position of an accelerator pedal, a first switch shiftable to a predetermined state in response to the accelerator pedal moving below a predetermined position, and a second switch shiftable to a predetermined state when a position which the power control element takes is less than a predetermined position;

wherein the control unit is operatively coupled with the first and second switches;

the control unit is operative to determine whether or not the actual position signal is equal to or less than a predetermined value;

the control unit is operative to determine whether or not the second switch is in the predetermined state thereof after the control unit determining that the actual position signal has been equal to or less than said predetermined value;

the control unit is operative to determine whether or not the first switch fails to take the predetermined state thereof after the control unit determining that the second switch has been in the predetermined state thereof;

the control unit is operative to determine that the first switch fails to operate normally in response to the control unit determining that the first switch has failed to take the predetermined state thereof after the second switch has been in the predetermined state thereof; and the control unit is operative to conduct a test routine, when the control unit determines that the first switch operates normally, to determine whether or not the power control element operates normally wherein the control unit determines that the power control element has failed to operate normally when the second switch fails to shift to the predetermined state thereof after the first switch has shifted to the predetermined state thereof.

8. The testing apparatus as claimed in claim 7, wherein the control unit is operative to determine whether or not the actual position signal continues to be equal to or less than said predetermined value for a first predetermined period of time.

9. The testing apparatus as claimed in claim 8, wherein the control unit is operative to determine whether or not the second switch continues to take the predetermined state thereof for a second predetermined period of time after the control unit determining that the actual position signal has continued to be equal to or less than said predetermined value for said first predetermined period of time.

10. The testing apparatus as claimed in claim 9, wherein the control unit is operative to determine whether or not the first switch continues to fail to take the predetermined state thereof for a third predetermined period of time after the control unit determining that the second switch has continued to take the predetermined state thereof for said second predetermined period of time.

11. The testing apparatus as claimed in claim 10, wherein the control unit is operative to determine that the first switch fails to operate normally in response to the control unit determining that the first switch has continued to fail to take the predetermined state thereof for said third predetermined period of time after the second switch has continued to take the predetermined state thereof for said second predetermined period of time.

12. The testing apparatus as claimed in claim 7, wherein the internal combustion engine is a gasoline engine.

13. The testing apparatus as claimed in claim 7, wherein the internal combustion engine is a diesel engine.

14. A testing method for a combustible charge intake system of an internal combustion engine, including a power control element positionable in response to a control signal to establish various states of combustible charge to be combusted in the internal combustion engine, a position sensor operatively coupled with the power control element to provide an actual position signal indicative of a position which the power control element takes, a control unit for developing the control signal as a predetermined function of a position of an accelerator pedal, a first switch shiftable to a predetermined state in response to the accelerator pedal moving below a predetermined position, and a second switch shiftable to a predetermined state when a position which the power control element takes is less than a predetermined position, the control unit being operatively coupled with the first and second switches and operative to determine that the power control element has failed to operate normally when the second switch fails to shift to the predetermined state thereof after the first switch has shifted to the predetermined state thereof, the testing method comprising the steps of:

determining whether or not the actual position signal is equal to or less than a predetermined value;

determining whether or not the second switch is in the predetermined state thereof after the control unit determining that the actual position signal has been equal to or less than said predetermined value;

determining whether or not the first switch fails to take the predetermined state thereof after the control unit determining that the second switch has been in the predetermined state thereof; and determining that the first switch fails to operate normally in response to the control unit determining that the first switch has failed to take the predetermined state thereof after the second switch has been in the predetermined state thereof.

* * * * *